US008578526B1

(12) United States Patent
Rosso

(10) Patent No.: US 8,578,526 B1
(45) Date of Patent: Nov. 12, 2013

(54) MODULAR LOUNGE MAT

(76) Inventor: Danielle M. Rosso, Williamsburg, VA (US)

( * ) Notice: Subject to any disclaimer, the term of this patent is extended or adjusted under 35 U.S.C. 154(b) by 187 days.

(21) Appl. No.: 13/111,081

(22) Filed: May 19, 2011

(51) Int. Cl.
*A47G 9/06* (2006.01)

(52) U.S. Cl.
USPC ..... 5/419; 5/417; 5/420; 5/632; 5/633

(58) Field of Classification Search
USPC ..... 5/417, 419, 420, 632, 633; 224/575, 224/153, 155, 156
See application file for complete search history.

(56) References Cited

U.S. PATENT DOCUMENTS

| | | | | | |
|---|---|---|---|---|---|
| 3,384,719 | A | | 5/1968 | Lanzara | |
| 4,546,507 | A | | 10/1985 | Weinstein | |
| 4,841,587 | A | * | 6/1989 | Carter et al. | 5/419 |
| 4,908,887 | A | | 3/1990 | Shaw, Jr. | |
| 4,999,863 | A | * | 3/1991 | Kane | 5/98.1 |
| 5,010,610 | A | * | 4/1991 | Ackley | 5/691 |
| 5,110,219 | A | | 5/1992 | Lopes | |
| 5,163,192 | A | | 11/1992 | Watson | |
| 5,199,120 | A | | 4/1993 | Holmes | |
| 5,265,292 | A | * | 11/1993 | Underell | 5/419 |
| 5,481,767 | A | | 1/1996 | Lewis | |
| 5,544,792 | A | * | 8/1996 | Arnwine | 224/153 |
| 5,588,696 | A | * | 12/1996 | Jay et al. | 297/129 |
| 5,628,544 | A | * | 5/1997 | Goodman et al. | 297/188.14 |
| 5,644,807 | A | | 7/1997 | Battistella | |
| 5,730,529 | A | | 3/1998 | Fritz et al. | |
| 6,193,118 | B1 | * | 2/2001 | Kearl | 224/153 |
| 6,354,477 | B1 | * | 3/2002 | Trummer | 224/575 |
| 6,651,853 | B2 | * | 11/2003 | Higgins et al. | 224/155 |
| 6,658,132 | B1 | * | 12/2003 | Moster et al. | 381/388 |
| 6,668,407 | B1 | | 12/2003 | Reitzel | |
| 6,848,746 | B2 | * | 2/2005 | Gentry | 297/380 |
| 6,951,035 | B2 | * | 10/2005 | Kinchen et al. | 5/420 |
| 7,171,707 | B2 | * | 2/2007 | Landay | 5/413 R |
| 7,177,420 | B2 | * | 2/2007 | Carter | 379/447 |
| 7,818,840 | B2 | * | 10/2010 | Barnett et al. | 5/627 |
| 2004/0206790 | A1 | * | 10/2004 | Welsh | 224/155 |
| 2007/0012735 | A1 | * | 1/2007 | Lee et al. | 224/155 |
| 2007/0084891 | A1 | * | 4/2007 | Gillespie | 224/155 |
| 2007/0122066 | A1 | * | 5/2007 | Landay | 383/16 |
| 2007/0246497 | A1 | * | 10/2007 | Indeddi | 224/575 |
| 2010/0127024 | A1 | * | 5/2010 | Cortes | 224/153 |
| 2010/0171341 | A1 | | 7/2010 | Loney | |

* cited by examiner

*Primary Examiner* — Robert G Santos
*Assistant Examiner* — David E Sosnowski
(74) *Attorney, Agent, or Firm* — Montgomery Patent & Design; Robert C. Montgomery

(57) ABSTRACT

A modular lounge mat including a pair of cushions attached to each other with a section of mesh, further includes a carrying case, a removable cover, and a headrest. The mesh allows the first cushion to be folded against the second cushion, thereby allowing the folded pair of cushions to be transported within the carrying case. The headrest includes a pair of speakers, audio wiring, and a means of connecting the speakers to an outside audio source.

19 Claims, 5 Drawing Sheets

MODULAR LOUNGE MAT

RELATED APPLICATIONS

The present invention was first described in a notarized Official Record of Invention on May 18, 2010, that is on file at the offices of Montgomery Patent and Design, LLC, the entire disclosures of which are incorporated herein by reference.

FIELD OF THE INVENTION

The present invention relates generally to portable lounge mats, and in particular, to modular lounge mat in combination with a carrying case for portable use during outdoor activities.

BACKGROUND OF THE INVENTION

Very few leisure time activities rival that of spending a warm summer day at the beach. Whether the beach is at an ocean or a small lake, the feeling that comes with being outside and near water is enjoyable. Most people usually bring a large assortment of supporting items with them while at the beach such as towels, books, music players, radios, and food. All of these items must be transported from their cars, bicycles, or beach homes to the beach itself. This often dictates many repeat trips when arriving at the beach and an equal number of trips when leaving. Additionally, many people find the comfort and padding afforded by beach towels unsatisfactory, thus forcing the user to bring cots, large chaise lounges, and other large bulky items.

There have been various attempts to provide beach mats which address these problems. Examples of these attempts range from kits having mats with integral pillows and mats in combination with tote carrying bags. Examples of these devices can be seen by reference in the following U.S. patents: U.S. Pat. No. 4,546,507, issued to Weinstein, discloses a beach kit including a beach towel, an inflatable pillow, and a pillow cover which is convertible into a carrying bag.

U.S. Pat. No. 4,908,887, issued to Shaw, Jr. discloses a mat assembly having a plurality of elongated flexibly connected ribs in parallel and foldable with each other such that the mat can be rollup or rolled out flat.

U.S. Pat. No. 5,110,219, issued to Lopes, discloses a combination beach mat and tote bag made of a fabric sheet material adapted to be folded in half along a line between the side edges such that the side edges are superimposed and can be zipped up to form an open tote bag.

U.S. Pat. No. 5,163,192, issued to Watson, discloses a sun bathing mat having a removably attachable and inflatable headrest for use on a beach or while visiting a pool. The mat includes an elongated fabric piece with a top portion which is foldable over an intermediate portion and is releasably attachable in this position to form a flap for enclosing the inflatable headrest.

U.S. Pat. No. 5,199,120, issued to Holmes, discloses a portable combined lounging mat and a pillow adapted to provide both a cushioned support for a user and a form around which the lounging mat wraps for transportation. The mat has extending side flaps for enlarging the usable mat surface area when opened to which the pillow is secured. At least one (1) storage compartment is provided on the mat for use when the mat is opened and is accessible when the mat is wrapped around the pillow.

U.S. Pat. No. 5,481,767, issued to Lewis, discloses a multipurpose beach blanket having a pillow and a wraparound support carrier that defines a storage member, pockets, and a handle. U.S. Pat. No. 5,730,529, issued to Fritz et al., discloses a combination beach mat and carrying device having a pillow section and several storage sections, each closed by a closure. The mat also has securing straps for binding the mat and a carrying strap for transportation.

While these devices may achieve their purported objectives each suffers from one or more disadvantage or deficiency related to design or utilization. Particularly, none of these attempts provide for a comfortable lounge mat that can be adjusted to a position desired by the user which is also conveniently portable.

SUMMARY OF THE INVENTION

The inventor has therefore recognized the aforementioned inherent problems and lack in the art and observed that there is a need for a suitable support for a user to lie on a beach provided with the additional benefit of organizing other beach-going related materials. In accordance with the invention, it is an object of the present disclosure to solve these problems.

The inventor recognized these problems and has addressed this need by developing a modular outdoor mat that allows for storage and transportation of beach related items in a manner which is quick, easy, and effective. The inventor has thus realized the advantages and benefits of providing the modular lounge mat and carrying case having a first cushion and a second cushion affixed to the first cushion by a mesh section affixed between opposing top transverse edges of the first cushion and the second cushion, such that the first and second cushions in combination are foldable about the mesh section between an unfolded state and a folded state. A rigid internal frame panel is affixed to an underside surface of the first cushion and a "U"-shaped support frame is pivotably attached to the frame panel to support the first cushion in a partially unfolded state.

A first strap extends from a side of the first cushion and a second strap extends from an opposing side of the first cushion. A buckle is provided for releasably securing the first strap and the second strap together around the first and second cushions in combination when in the folded state.

Additionally, a carrying case is provided having a first case half and a second case half affixed to the first case half by a flexible bottom member affixed between opposing bottom transverse edges of the first case half and the second case half, such that the first and second case halves in combination are foldable about the bottom member between an open state and a closed state. The first and second case halves in combination define a hollow interior when in the closed state for receiving the first and second cushions in combination when in the folded state.

A third strap extends from an edge of the first case half opposite the bottom member having a second fastener disposed on an end thereof and a third fastener is affixed to an exterior of the second case half for releasably securing the third strap to the second case half when the first and second case halves in combination are in the closed state.

A head rest is removably attachable to an upper end of the first cushion or the second case half exterior. The headrest includes a flat side for contacting the first cushion or the second case half and a contoured side opposite the flat side for supporting a head of the user. The headrest also includes at least one waterproof speaker in electrical communication with an audio jack suitable for connection to a personal electronic music device.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

Figure 1:
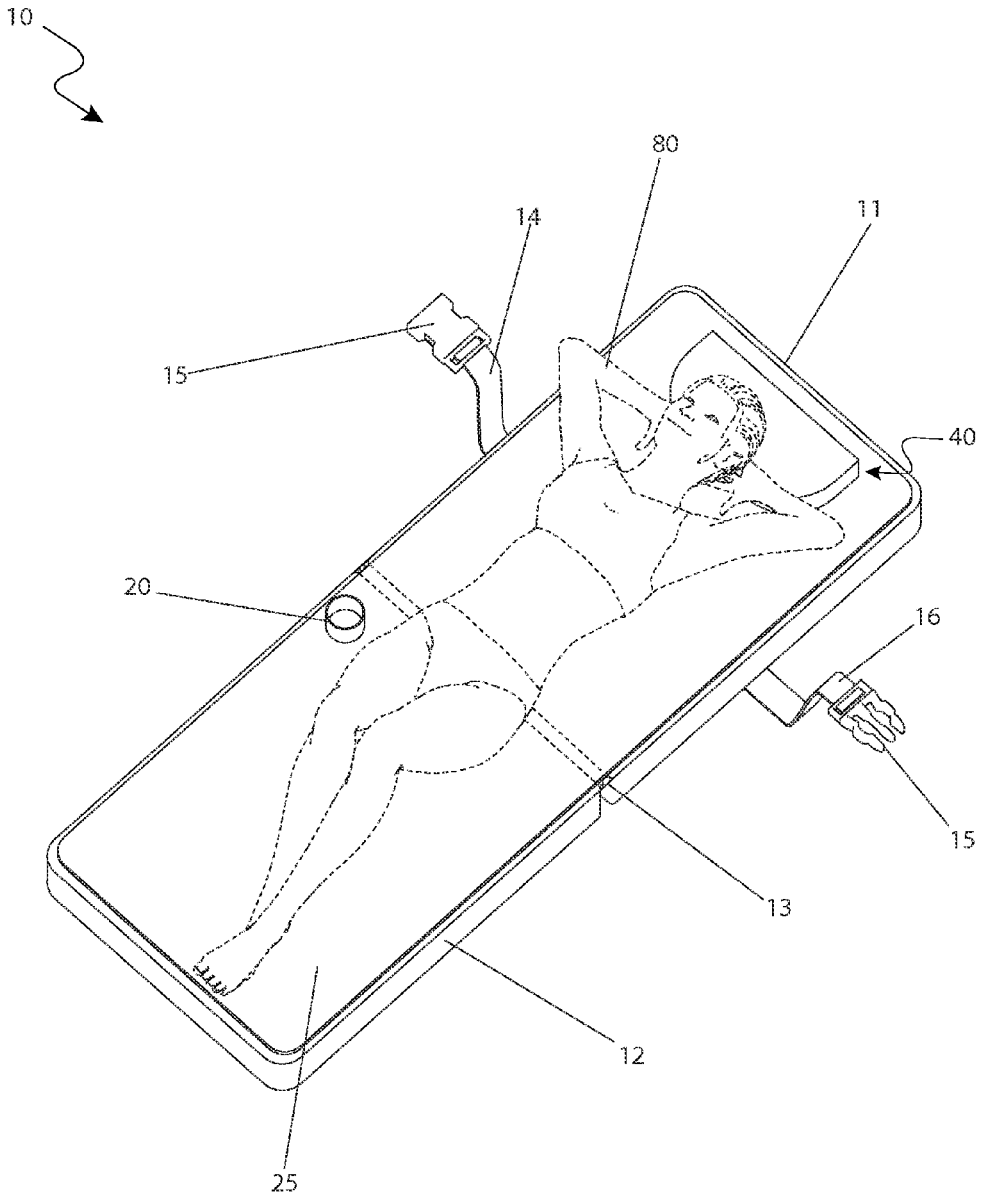
FIG. 1 is a perspective environmental view of a modular lounge mat depicted in an in-use state, according to a preferred embodiment in accordance with the invention.

| DESCRIPTIVE KEY | |
|---|---|
| 10 | modular lounge mat |
| 11 | first cushion |
| 12 | second cushion |
| 13 | mesh |
| 14 | first strap |
| 15 | buckle |
| 16 | second strap |
| 17 | first covering |
| 18 | second covering |
| 19 | first cushion filler |
| 20 | cup holder |
| 21 | second cushion filler |
| 23a | first fastener |
| 23b | second fastener |
| 23c | third fastener |
| 24 | third strap |
| 25 | fabric cover |
| 30 | carrying case |
| 31 | first case half |
| 32 | second case half |
| 33a | first handle |
| 33b | second handle |
| 34a | fourth strap |
| 34b | fifth strap |
| 35 | bottom member |
| 36a | first clasp |
| 36b | second clasp |
| 37 | first pocket |
| 38a | second pocket |
| 38b | second pocket closure |
| 39a | third pocket |
| 39b | third pocket closure |

-continued

| DESCRIPTIVE KEY | |
|---|---|
| 40 | detachable headrest |
| 41 | resting portion |
| 42a | first speaker |
| 42b | second speaker |
| 43 | audio jack |
| 44 | switch |
| 45 | audio wiring |
| 49 | internal frame panel |
| 50 | support assembly |
| 51 | support frame |
| 52a | first tension member |
| 52b | second tension member |
| 80 | user |
| 81 | ground |

DETAILED DESCRIPTION OF THE PREFERRED EMBODIMENT

In accordance with the invention, the best mode is presented in terms of a preferred embodiment, herein depicted within FIGS. 1 through 7. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 7, depicting a modular lounge mat (herein described as an "apparatus") 10, where like reference numerals represent similar or like parts. In accordance with the invention, the present disclosure describes a modular apparatus which provides a compact and easily transportable lounge mat for a user to enjoy sunbathing and other outdoor activities.

FIG. 1 shows a perspective environmental view of the apparatus 10 depicted as covered by a fabric cover 25 and occupied by a user 80. The apparatus 10 includes a first cushion 11 permanently connected to a second cushion 12 by a mesh 13, and a first strap 14, a buckle 15, and a second strap 16.

Figure 2:
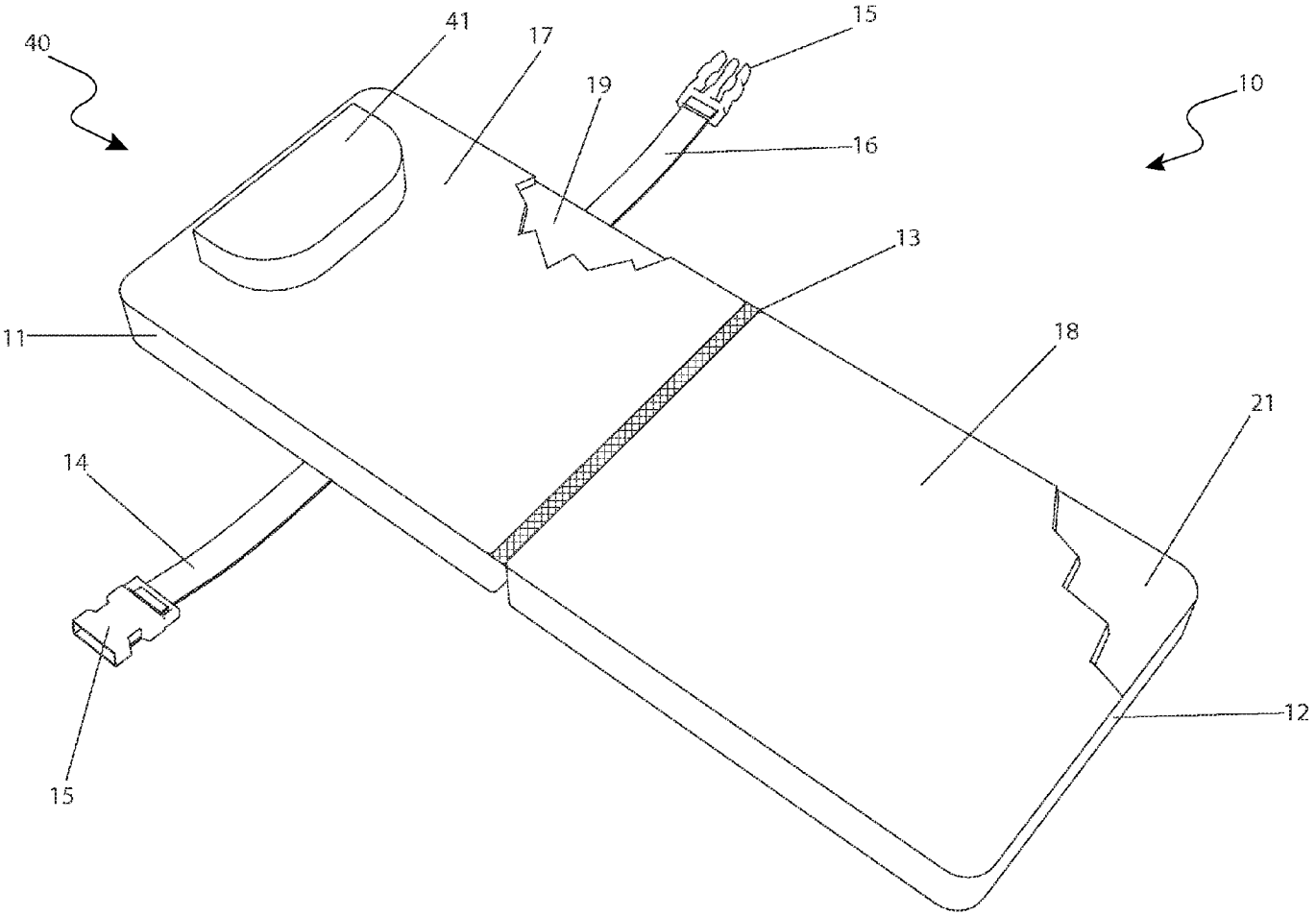
FIG. 2 is a perspective view of the modular lounge mat depicted in a fully deployed state, according to the preferred embodiment.

FIG. 2 shows a perspective view of the apparatus 10 depicted as fully deployed. The buckle 15 preferably includes a side-release latch fitting or equivalent latching device and strap length adjustment features. The first cushion 11 includes a first cushion filler 19, made of a foam-type of material, and is covered by a first covering 17, made of a waterproof material such as VINYL®. The first cushion 11 further includes a rigid internal frame panel 49 along an inner back surface being made of wood, fiberglass, or the like, which provides planar support to a subjacent support frame 51 allowing a user 80 to configure the apparatus 10 in a reclining position.

The second cushion 12 includes an integral cylindrical cup holder 20 along a side edge, a second cushion filler 21, and is covered by a second covering 18, wherein the second filler 21 and the second covering 18 are made of materials similar to those included within the first cushion 11.

Furthermore, the apparatus 10 includes a detachable headrest 40 fastened onto an upper portion of the first cushion 11 by first fasteners 23*a*, preferably including sewn-on VEL- CRO® hook-and-loop fastener strips or equivalent fastening means. The first cushion 11 and the second cushion 12 are affixed to each other by the mesh 13 which is permanently fastened by chemical bonding, welding, or stitching, onto a lower end transverse top edge of the first cushion 11 and a corresponding upper end top edge of the second cushion 12. The mesh 13 allows for the folding of the first cushion 11 onto the second cushion 12. The first strap 14, the buckle 15, and the second strap 16 provide for securing the first cushion 11 and the second cushion 12 together in the folded configuration.

Figure 3:
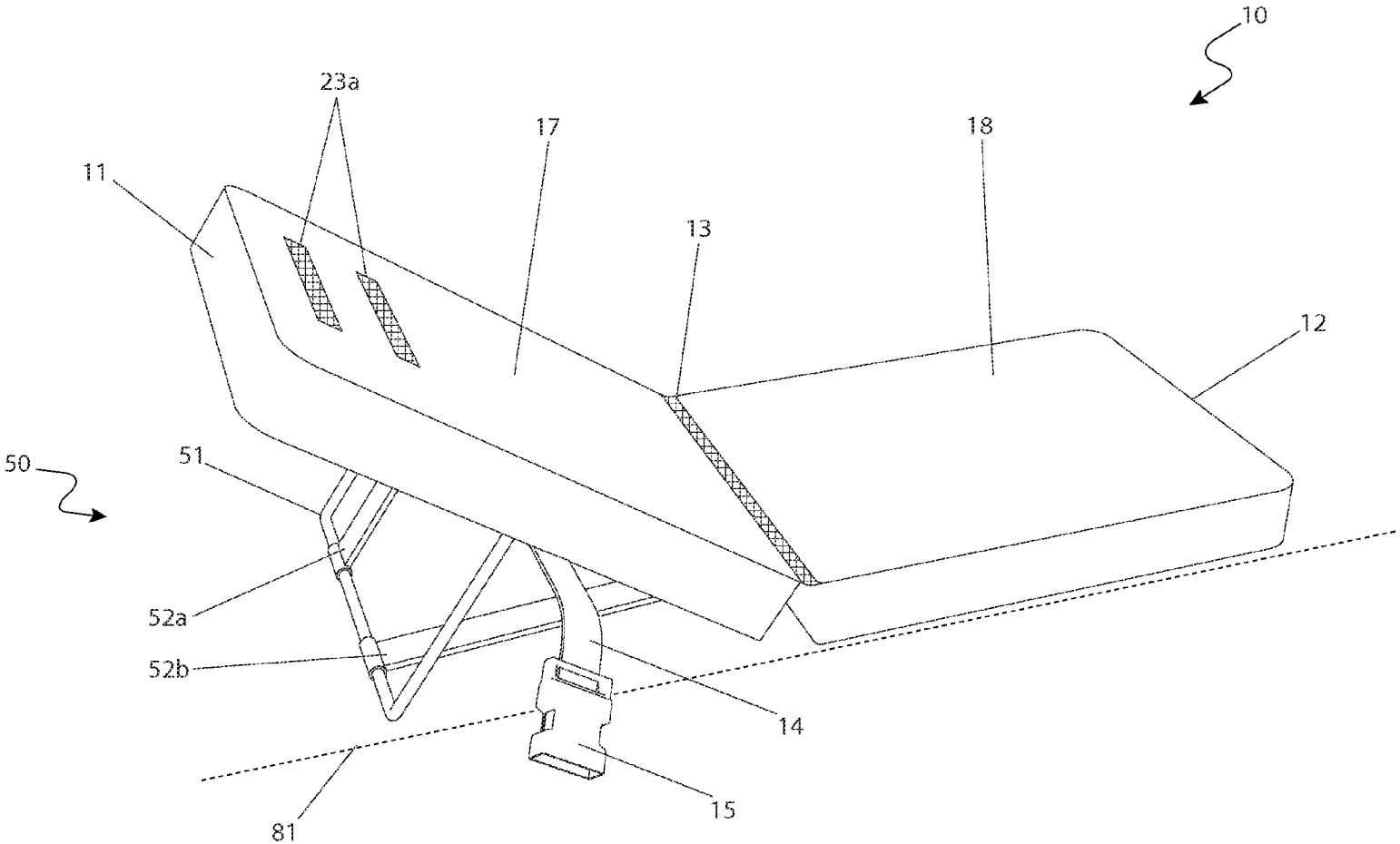
FIG. 3 is a perspective view of the modular lounge mat depicted in partially raised state, according to the preferred embodiment.

FIG. 3 shows a perspective view of the apparatus 10 wherein the first cushion 11 is depicted in a partially raised state. The partially raised state of the first cushion 11 is supported by the pivotably attached support assembly 50 which is hingedly affixed to the aforementioned internal frame panel 49 of the first cushion 11. The support assembly 50 includes a "U"-shaped support frame 51 made of plastic or aluminum tubing. A pair of crossed tension members 52*a*, 52*b*, made of canvas or plastic, is intended to secure the supporting position of the support frame 51. All members of the support assembly 50 are envisioned to be detachably fastened onto an underside surface of the first cushion 11 by overlapping straps fastened onto each other by either snaps or hook-and-loop-type closures when not in use.

Figure 4:
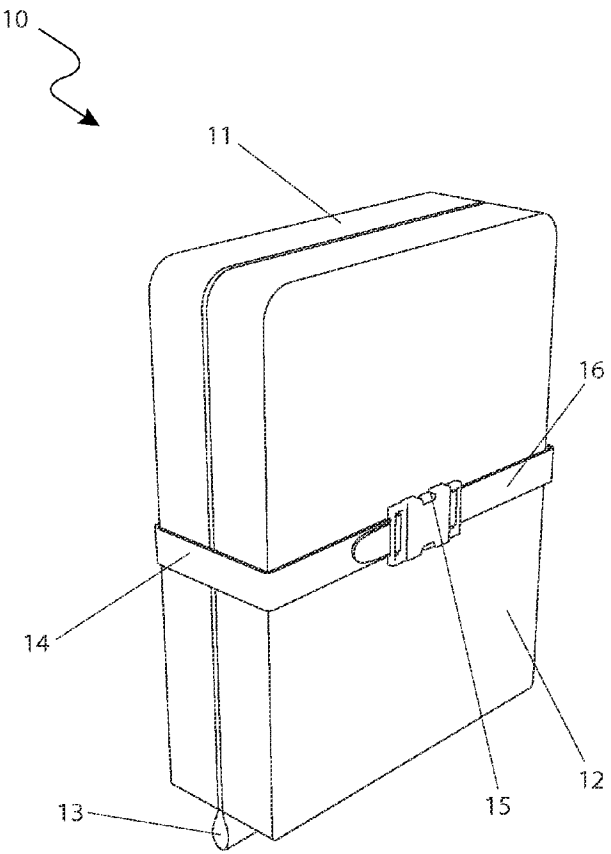
FIG. 4 is a perspective view of the modular lounge mat depicted in a fully collapsed state, according to the preferred embodiment.

FIG. 4 shows a perspective view of the apparatus 10 depicted in a folded and secured state. The first cushion 11 is secured against the second cushion 12 by the encircling assembly of first strap 14 and the second strap 16 fastened to each other by the buckle 15.

Figure 5:
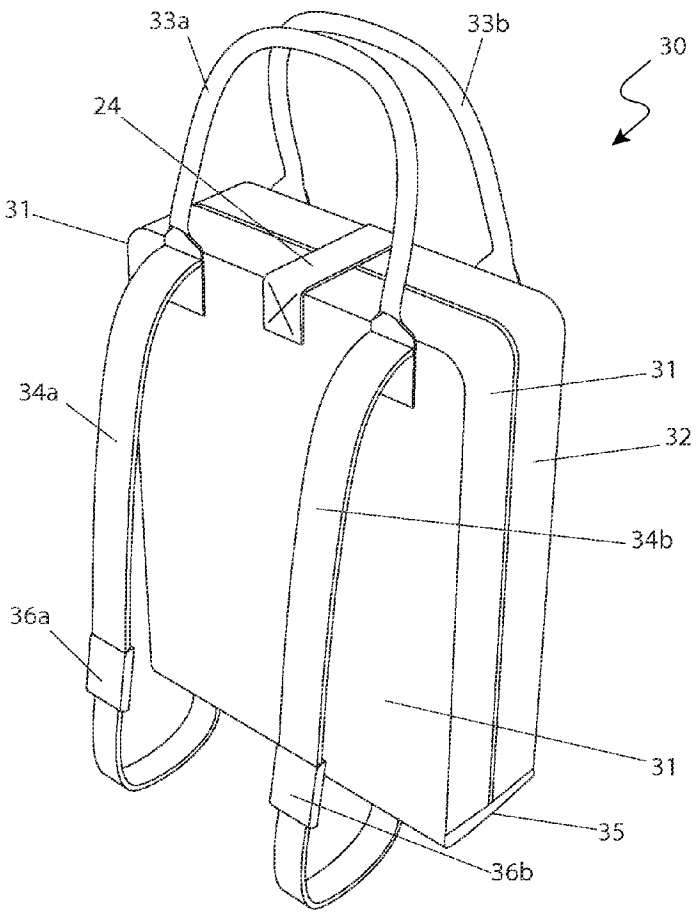
FIG. 5 is a perspective view of the modular lounge mat depicted within a carrying case, according to the preferred embodiment.

FIG. 5 shows a perspective view of the apparatus 10 depicted as folded and secured within a carrying case 30. The carrying case 30 includes a first case half 31 and a second case half 32 defining hollow rectangular containers having side walls approximately as deep as a corresponding thickness of the first cushion 11 and second cushion 12. Transverse lower edges of the case halves 31, 32 are permanently connected to each other by a flexible connecting bottom member 35, preferably a mechanical hinge or a living hinge. An upper edge portion of the first case half 31 includes a first handle 33*a*, while a corresponding upper edge portion of the second case half 32 includes a second handle 33*b*, designed to provide in conjunction with each other, a means for carrying the folded carrying case 30, including the folded pair of cushions 11, 12. It is envisioned that an actual length of the handles 33*a*, 33*b* may be configured based upon a user's 80 carrying preference. The handles 33*a*, 33*b* are preferably adjusted between a shorter configuration to enable transportation of the apparatus 10 using one's hand or in a longer configuration so as to enable usage as a shoulder strap by draping the handles 33*a*, 33*b* over a shoulder portion.

The carrying case 30 is secured by a third strap 24 sewn to an upper central portion of the first case half 31 of the carrying case 30 and includes a second fastener 23*b* at a distal end thereof. The second fastener 23*b* engages a third fastener 23*c* located at a corresponding top upper edge of the second case half 32, such that the first 11 and second 12 cushions are secured within the carrying case 30.

A fourth strap 34*a* and a fifth strap 34*b* allow the carrying case 30 to be alternately carried in a backpack manner. A first clasp 36*a* and a second clasp 36*b* allow the straps 34*a*, 34*b* to be adjusted to a comfortable length. The carrying case 30 is made of canvas or plastic materials, and all handles and straps 33*a*, 33*b*, 34*a*, 34*b*, are preferably permanently fastened onto the first case half 31 and the second case half 32 by chemical bonding, welding or stitching.

Figure 6:
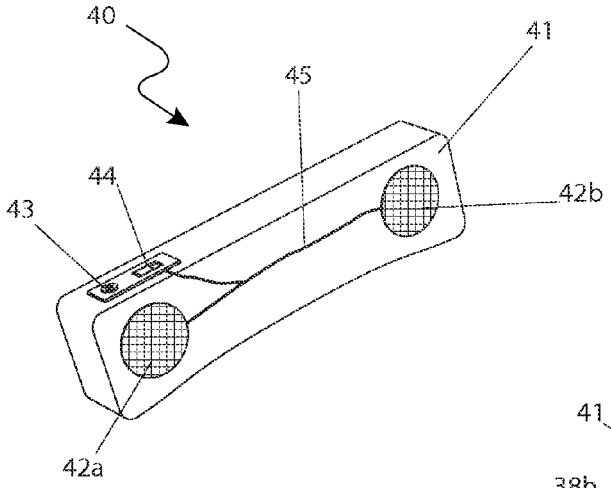
FIG. 6 is a perspective view of a detachable head rest of the modular lounge mat, according to the preferred embodiment; and, FIG. 7 is a perspective view of the carrying case for the modular lounge mat depicted in a deployed state, according to the preferred embodiment.

FIG. 6 shows a perspective view of the detachable head rest 40. The detachable head rest 40, made of similar padding and covering materials as the cushions 11, 12, includes a contoured resting portion 41 and is detachably fastened onto either the upper face of the first cushion 11 or the outside upper face of the carrying case 30 by the plurality of first fasteners 23*a*. The interior padded portion of the headrest 40 includes a waterproof version of a first speaker 42*a* and a second speaker 42*b*, interconnected by an audio wiring 45. An audio jack 43 and an ON/OFF switch 44 are included within a rear face portion of the headrest 40 and interconnected with internal audio wiring 45.

Figure 7:
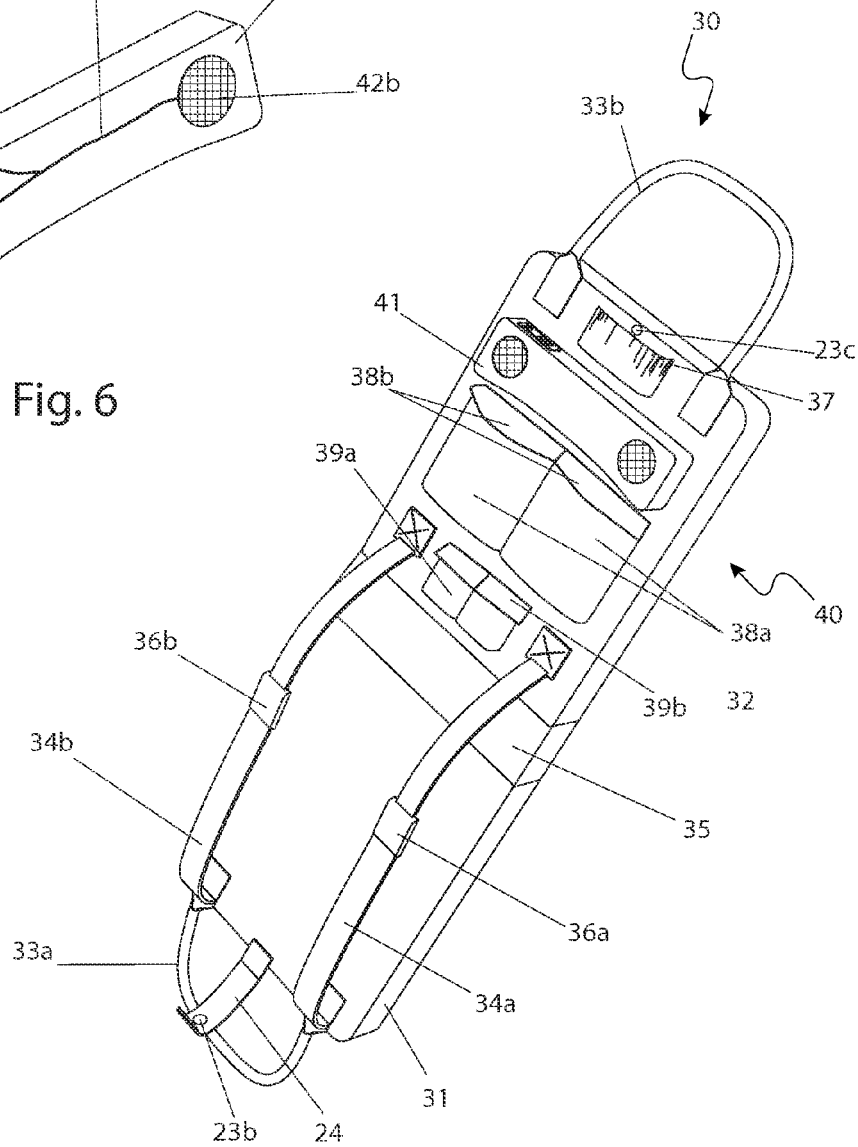

FIG. 7 shows a perspective view of an outer face of the carrying case 30 depicted in a deployed state. The outer face of the second case half 32 includes the headrest 40 detachably fastened onto an upper outer portion of the second case half 32 by a plurality of first fasteners 23*a*, such as a hook-and-loop-type closure. The outer face of the second case half 32 further includes a first pocket 37, a pair of second pockets 38*a*, and a third pocket 39*a*, all including integral members of the second case half 32 are designed to carry a plurality of amenities.

The first pocket 37 is illustrated here including an elastic-type closure construction while the second pockets 38*a* and the third 39*a* pocket preferably include respective flap-type second pocket closures 38*b* and a third pocket closure 39*b* to secure the amenities inside. The closures 38*b*, 39*b* preferably include methods such as, but not limited to: hook-and-loop fasteners, loop and button-type fasteners, various latches and hasps, and the like. Furthermore, the second pocket 38*a* and third pocket 39*a* are preferably sewn to the carrying case 30 or alternately removably attached using fasteners such as VELCRO® allowing a user 80 to utilize the pockets 38*a*, 39*a* in a portable manner. It can be appreciated by one skilled in the art that the apparatus 10 is not limited to the particular depicted arrangement, construction, and number of the pockets 37, 38*a*, 39*a* shown here, but any number of various types of pockets can be arranged along front, rear, and side outer surfaces of the carrying case 30 without deviating from the concept and as such, should not be interpreted as a limiting factor of the apparatus 10. An upper transverse edge of the first case half 31 includes the third strap 24 intended to secure the folded configuration of the carrying case 30 by closing a second fastener 23*b* onto a corresponding third fastener 23*b*.

It is envisioned that other styles and configurations can be easily incorporated into the teachings of the present disclosure and only one particular configuration has been shown and described for purposes of clarity and disclosure and not by way of limitation of scope.

In accordance with the invention, the preferred embodiment can be utilized by the user in a simple and effortless manner with little or no training. After initial purchase or acquisition of the apparatus 10, it would be installed as indicated in FIG. 1.

The method of utilizing the apparatus 10 can be achieved by performing the following steps: unpacking all components of the apparatus 10; unfolding and checking for damage; folding the first cushion 11 onto the second cushion 12; securing the first cushion 11 against the second cushion 12 by encircling the cushions 11, 12 with straps 14, 16; engaging the half portions of the buckle 15; placing the deployed carrying case 30 onto a floor surface with the interior portion facing upward; placing the folded and secured first cushion 11 and second cushion 12 assembly onto the bottom member 35 of the carrying case; moving the first case half 31 into a vertical position by using a first hand; retaining the vertical position of the first case half 31; using a second hand to raise the second case half 32 into the vertical position; securing the assembly by placing the third strap 24 over the top portion of the assembly of the apparatus 10; fastening the second fastener 23*b* of the third strap 24; placing the desired amenities into the pockets 37, 38*a*, 39*a* and securing using the first pocket closures 38*b* and third pocket closures 39*b*; transporting the apparatus 10 to a desired location; performing the above described steps in reverse order at the desired location; leaving the first cushion 11 and the second cushion 12 in a deployed state; or, raising the first cushion by assembling and installing the detachable support assembly 50; covering the first cushion 11 and the second cushion 12 with the fabric cover 25; after use, transporting the apparatus 10 to the home location after following the above described assembly steps; cleaning the apparatus 10 as needed; and, storing the apparatus 10.

The method of utilizing the headrest 40 can be achieved by utilizing the first fasteners 23*a* to affix the headrest 40 onto the outer face portion of the first cushion 11.

The method of utilizing the audio apparatus speakers 42*a*, 42*b* can be achieved by connecting one's personal audio device to the apparatus 10 using the audio jack 43 and activating a normal audio function of the speakers 42*a*, 42*b* using the ON/OFF switch 44.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A modular lounge mat comprising:

a first cushion and a second cushion affixed to said first cushion by a mesh section affixed between opposing top transverse edges of said first cushion and said second cushion such that said first and second cushions in combination are foldable about said mesh section between an unfolded state and a folded state, said first cushion and said second cushion being substantially parallel when in said folded state; and said first cushion being disposed at a non-zero relative to said second cushion when in said unfolded state;

a support frame pivotably attached to an underside surface of said first cushion to support said first cushion in a partially unfolded state;

a first strap comprising a free end extending from a side of said first cushion, said first strap being configured to at least partially encircle said second cushion from said side of said first cushion when in said folded state;

a second strap comprising a free end extending from an opposing side of said first cushion, said second strap being configured to at least partially encircle said second cushion from said opposing side of said first cushion when in said folded state, said first strap and said second strap being configured to completely encircle said second cushion and secure said first cushion and said second cushion in said folded state;

a first buckle affixed to said free end of said first strap;

a second buckle affixed to said free end of said second strap, said first buckle and said second buckle being configured to releasably connect said free end of said first strap directly to said free end of said second strap; and, a head rest comprising a first fastener removably attachable to a matching first fastener disposed on an upper end of a topside surface of said first cushion to attach said head rest to said upper end of a topside surface of said first cushion.

2. The mat of claim 1, wherein said first cushion and said second cushion each further comprise a foam cushion filler surrounded by a waterproof covering.

3. The mat of claim 2, wherein said first cushion further comprises a rigid internal frame panel affixed to an underside surface of said first cushion foam cushion filler.

4. The mat of claim 3, wherein said support frame further comprises a generally "U"-shaped member having ends pivotably attached to said internal frame panel.

5. The mat of claim 4, further comprising at least one tension member affixed between said support frame and said internal frame panel to limit outward pivoting motion of said support frame relative to said first cushion.

6. The mat of claim 5, wherein said support frame is releasably securable to an underside surface of said first cushion when said first and second cushions in combination are in said unfolded state and said folded state.

7. The mat of claim 6, wherein said second cushion further comprises an integral cup holder disposed at least partially though a top surface thereof.

8. The mat of claim 6, further comprising a first fabric covering removably coupled to a topside surface of said first cushion and a second fabric covering removably coupled to a topside surface of said second cushion.

9. The mat of claim 6, further comprising a carrying case comprising a first case half and a second case half affixed to said first case half suitable to receive said first and second cushions in combination when in said folded state.

10. The mat of claim 9, wherein said head rest is removably attachable to an exterior of said carrying case when removed from said first cushion, said head rest comprising:

a flat side comprising said first fastener for contacting said first cushion or said second case half, said second case half also comprising a matching first fastener to attach said head rest to said second case half;

a contoured side opposite said flat side for supporting a head of a user; and, at least one waterproof speaker in electrical communication with an audio jack suitable for connection to a personal electronic music device.

11. The mat of claim 1, further comprising a carrying case suitable to receive said first and second cushions in combination when in said folded state, said carrying case comprising:

a first case half and a second case half affixed to said first case half by a flexible bottom member affixed between opposing bottom transverse edges of said first case half and said second case half such that said first and second case halves in combination are foldable about said bottom member between an open state and a closed state;

a third strap extending from an edge of said first case half opposite said bottom member;

a second fastener disposed on an end of said third strap; and, a third fastener affixed to an exterior of said second case half for attachment to said second fastener to releasably secure said third strap to said second case half when said first and second case halves in combination are in said closed state;

wherein said first and second case halves in combination define a hollow interior when in said closed state for receiving said first and second cushions in combination when in said folded state.

12. The mat of claim 11, wherein said carrying case further comprises a pair of handles affixed to ends of said first case half and said second case half opposing said bottom member, respectively, such that said handles are adjacently positioned when said first and second case halves in combination are in said closed state.

13. The mat of claim 12, wherein said carrying case further comprises a pair of length adjustable shoulder straps, each extending from an exterior of said first case half for securing said first and second cushions in combination when in said closed state about a wearer's body for carrying purposes.

14. The mat of claim 13, wherein said carrying case further comprises a plurality of storage pockets affixed to said second case half exterior.

15. The mat of claim 14, wherein said head rest is removably attachable to an exterior of said second case half when said head rest is removed from said first cushion.

16. The mat of claim 15, wherein said head rest further comprises:

a flat side comprising said first fastener for contacting said first cushion or said second case half, said second case half also comprising a matching first fastener to attach said head rest to said second case half;

a contoured side opposite said flat side for supporting a head of a user; and, at least one waterproof speaker in electrical communication with an audio jack suitable for connection to a personal electronic music device.

17. A modular lounge mat and carrying case comprising:

a first cushion and a second cushion affixed to said first cushion by a mesh section affixed between opposing top transverse edges of said first cushion and said second cushion such that said first and second cushions in combination are foldable about said mesh section between an unfolded state and a folded state, said first cushion and said second cushion being substantially parallel when in said folded state; and said first cushion being disposed at a non-zero relative to said second cushion when in said unfolded state;

a rigid internal frame panel affixed to an underside surface of said first cushion;

a U-shaped support frame pivotably attached to said frame panel to support said first cushion is a partially unfolded state;

a first strap comprising a free end extending from a side of said first cushion, said first strap being configured to at least partially encircle said second cushion from said side of said first cushion when in said folded state;

a second strap comprising a free end extending from an opposing side of said first cushion, said second strap being configured to at least partially encircle said second cushion from said opposing side of said first cushion when in said folded state, said first strap and said second strap being configured to completely encircle said second cushion and secure said first cushion and said second cushion in said folded state;

a first buckle affixed to said free end of said first strap;

a second buckle affixed to said free end of said second strap, said first buckle and said second buckle; being configured to releasably connect said free end of said first strap directly to said free end of said second strap;

a first case half and a second case half affixed to said first case half by a flexible bottom member affixed between opposing bottom transverse edges of said first case half and said second case half such that said first and second case halves in combination are foldable about said bottom member between an open state and a closed state, said first and second case halves in combination define a hollow interior when in said closed state for receiving said first and second cushions in combination when in said folded state;

a third strap extending from an edge of said first case half opposite said bottom member;

a second fastener disposed on an end of said third strap; and, a third fastener affixed to an exterior of said second case half for attachment to said second fastener to releasably secure said third strap to said second case half when said first and second case halves in combination are in said closed state; and, a head rest comprising a first fastener removably attachable to a matching first fastener disposed on an upper end of a topside surface of said first cushion to attach said head rest to said upper end of a topside surface of said first cushion or another matching first fastener disposed on an exterior of said case second half for to attach said head rest to said second case half.

18. The mat and carrying case of claim 17, wherein said head rest further comprises:

a flat side comprising said first fastener for contacting said first cushion or said second case half;

a contoured side opposite said flat side for supporting a head of a user; and, at least one waterproof speaker in electrical communication with an audio jack suitable for connection to a personal electronic music device.

19. The mat and carrying case of claim 17, wherein said support frame is releasably securable to an underside surface of said first cushion when said first and second cushions in combination are in said unfolded state and said folded state.

* * * * *